US009072957B1

(12) United States Patent
Chuck

(10) Patent No.: US 9,072,957 B1
(45) Date of Patent: Jul. 7, 2015

(54) GOLF SWING TRAINING APPARATUS FOR MAINTANING ARMS IN PROPER POSITION THROUGHOUT A GOLF SWING AND METHOD OF USING THE SAME

(71) Applicant: Martin Chuck, Chandler, AZ (US)

(72) Inventor: Martin Chuck, Chandler, AZ (US)

( * ) Notice: Subject to any disclaimer, the term of this patent is extended or adjusted under 35 U.S.C. 154(b) by 0 days.

(21) Appl. No.: 14/495,855

(22) Filed: Sep. 24, 2014

Related U.S. Application Data

(60) Provisional application No. 61/926,895, filed on Jan. 13, 2014.

(51) Int. Cl.
*A63B 69/36* (2006.01)

(52) U.S. Cl.
CPC ..... *A63B 69/3608* (2013.01); *A63B 2209/14* (2013.01)

(58) Field of Classification Search
USPC ..... 473/207.212, 219, 227, 256, 257, 266, 473/276, 409
See application file for complete search history.

(56) References Cited

U.S. PATENT DOCUMENTS

| | | | | |
|---|---|---|---|---|
| 5,735,776 | A * | 4/1998 | Swezey et al. | 482/91 |
| 5,839,968 | A * | 11/1998 | Latella | 473/219 |
| 6,176,790 | B1 * | 1/2001 | Latella | 473/219 |
| 7,758,437 | B1 * | 7/2010 | Stewart | 473/212 |
| 2008/0119299 | A1 * | 5/2008 | Merrill | 473/212 |

* cited by examiner

*Primary Examiner* — Nini Legesse
(74) *Attorney, Agent, or Firm* — Greenberg Traurig, LLP

(57) ABSTRACT

An apparatus configured to be held between a user's forearms during a golf swing. The apparatus can be a spherical, inflated ball. The apparatus may be further secured using a lanyard or similar article worn around the golfer's neck. In practice, by maintaining the inflated ball positioned between the forearms during the golf swing, the golfer is maintaining his or her arms in the proper position. If the inflated ball falls or fails to remain held in place between the forearms, the golf swing is poor (i.e., the arms have separated too much). Other spherical members can be used as well.

5 Claims, 4 Drawing Sheets

GOLF SWING TRAINING APPARATUS FOR MAINTANING ARMS IN PROPER POSITION THROUGHOUT A GOLF SWING AND METHOD OF USING THE SAME

CROSS-REFERENCE

This application claims priority to U.S. Patent Application No. 61/926,895 filed Jan. 13, 2014 and which is incorporated herein for any and all purposes.

FIELD OF THE INVENTION

The embodiments of the present invention relate to an article configured to rest between a golfer's arm during a golf swing thereby maintaining the golfer's arms in the proper position throughout a golf swing.

BACKGROUND

Golf is a very popular game. Approximately 30 million people in the U.S. play golf. The number worldwide is significantly higher. A good golf swing is the key to mastering the game of golf. Unfortunately, a good golf swing is made up of many, many facets and most people are not born with the skill.

Accordingly, it would be beneficial to develop a new, easy-to-use apparatus for training a person at least one facet of a good golf swing. More particularly, the apparatus disclosed herein teaches a person proper arm position through a golf swing.

SUMMARY

The embodiments of the present invention are directed to an apparatus configured to be held between a user's forearms during a golf swing. In one embodiment, the apparatus is a spherical, inflated ball. The apparatus may be further controlled using a lanyard or similar article worn around the user's neck. In practice, by maintaining the inflated ball positioned between the forearms during the golf swing, the golfer is assured of maintaining his or her arms in the proper position. If the inflated ball falls or fails to remain held in place between the forearms, the golf swing is poor (i.e., the arms have separated too much). In another embodiment, a non-inflatable spherical ball of any type may be used (e.g., foam ball).

Other variations, embodiments and features of the present invention will become evident from the following detailed description, drawings and claims.

DETAILED DESCRIPTION

Figure 1:
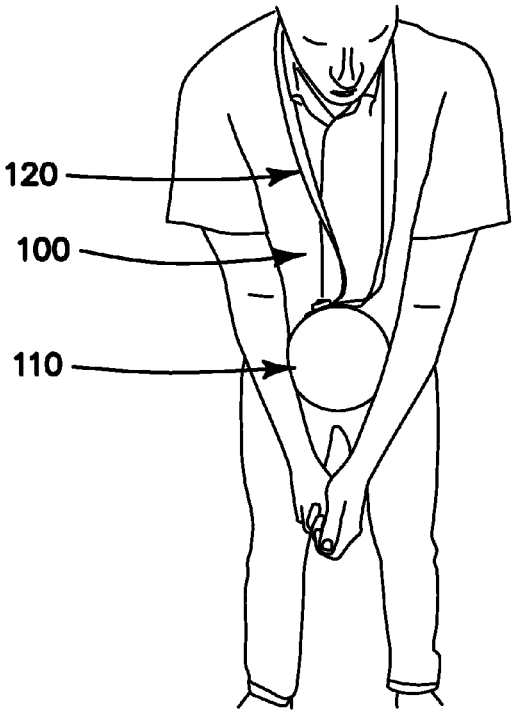
FIG. 1 illustrates a front view of a user with a golf swing apparatus in a first position according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 2:
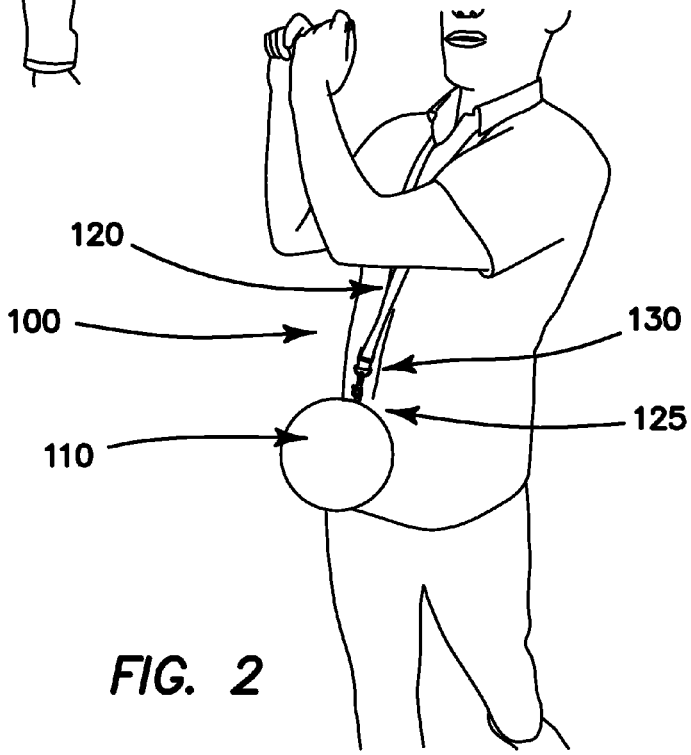
FIG. 2 illustrates a front view of a user with the golf swing apparatus in a fallen, improper position according to the embodiments of the present invention.
Figure 3A:
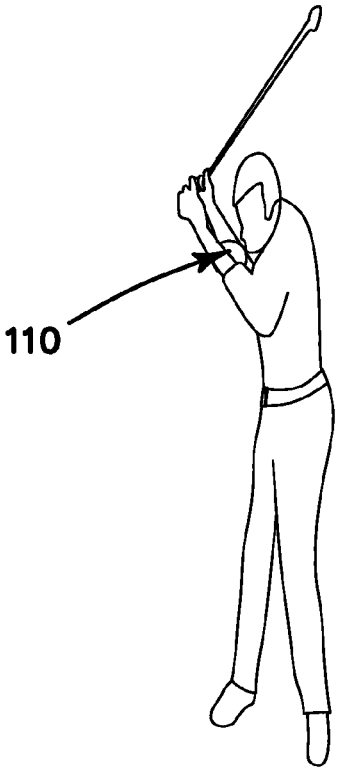
FIGS. 3A-3G illustrate the golf swing apparatus in proper position throughout a golf swing according to the embodiments of the present invention.
Figure 3B:
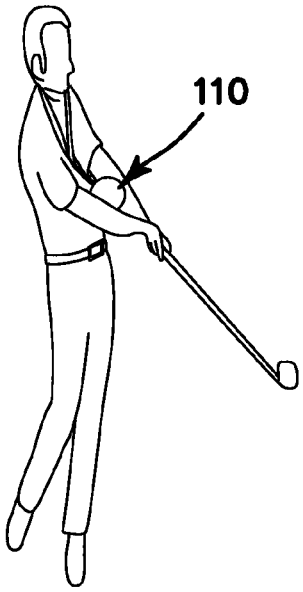
Figure 3C:
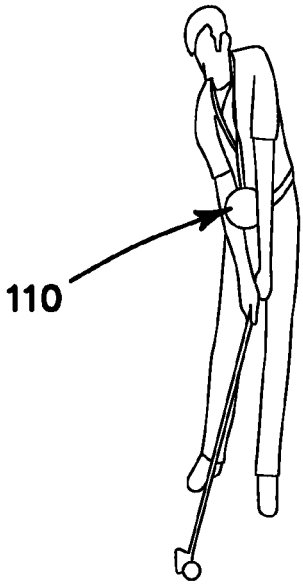
Figure 3D:
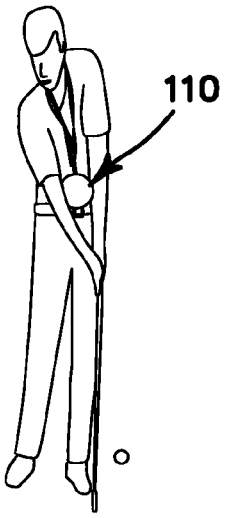
Figure 3E:
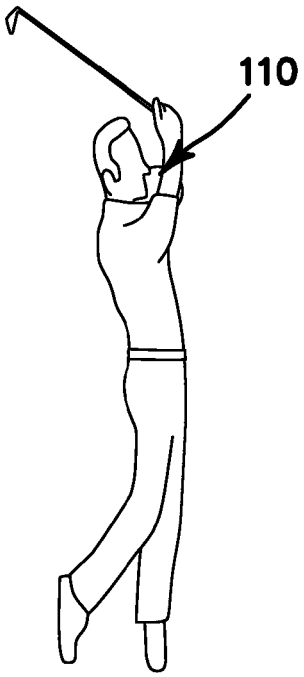
Figure 3F:
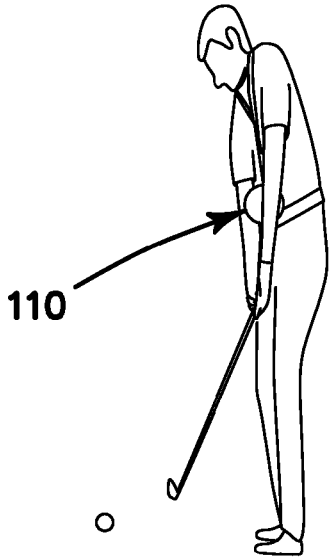
Figure 3G:
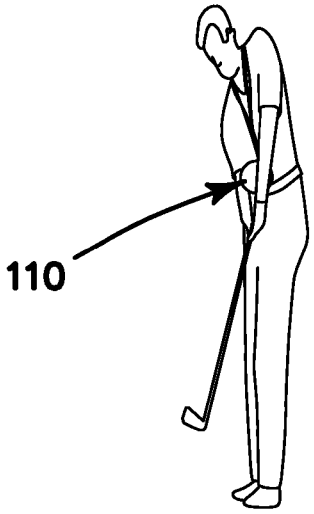

FIGS. 1 and 2 show a golf swing apparatus 100 according to the embodiments of the present invention. The golf swing apparatus 100 comprises an inflated ball 110 and connected lanyard 120. A boss 125 extending from the inflated ball 110 permits the lanyard 120, via clip 130, to removably connect to the inflated ball 110. While lanyard 120 is shown, any article, including a string, band, ribbon or strap, may be used to retain the inflated ball 110 around the golfer's neck.

FIG. 1 shows a view of a user with the inflated ball 110 in the proper position at the start of a golf swing. Ideally, at this point, the inflated ball 110 rests between the golfer's forearms slightly below the elbow. FIG. 2 shows a view of a golfer with the inflated ball 110 in an improper position (i.e., dangling) at a top of a backswing. Ideally, during a proper golf swing, the inflated ball 110 should remain between the golfer's forearms slightly below the elbows throughout the golf swing.

Figure 4:
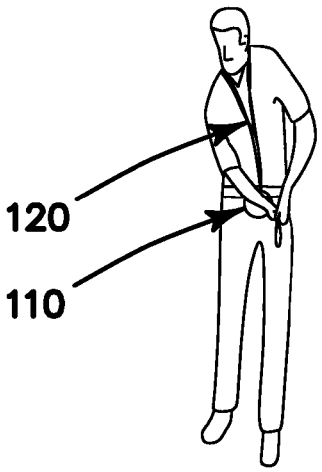
FIG. 4 illustrates the golf swing apparatus having fallen during a poor swing according to the embodiments of the present invention.
Figure 5:
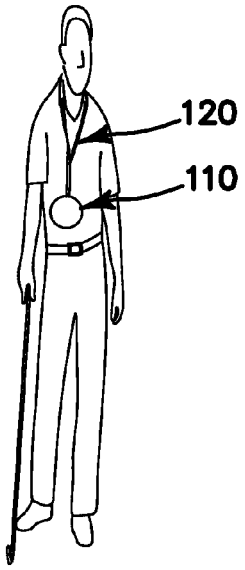
FIG. 5 illustrates the golf swing apparatus hanging around a user's neck according to the embodiments of the present invention.

FIGS. 3A-3G show the inflated ball 110 in proper position throughout a golf swing. Specifically, FIGS. 3A-3G show the inflated ball 110 remaining between the golfer's forearms as the golf swing progresses through the backswing, front swing and follow through. Should the inflated ball 110 fall, as shown in FIGS. 2 and 4, the golfer improperly broke or separated his or her arms during the swing. Such an outcome is indicative of a poor golf swing. Therefore, the inflated ball 110 serves to teach a golfer to keep his or her arms properly positioned thereby improving the golf m FIG. 5 shows the inflated ball 110 hanging around a golfer's neck via the lanyard 120. The lanyard 120 maintains the inflated ball 110 in position for convenient use and additionally prevents the inflated ball 110 from falling to the ground or being struck by a golf club or body part requiring the user to retrieve the same.

Figure 6A:
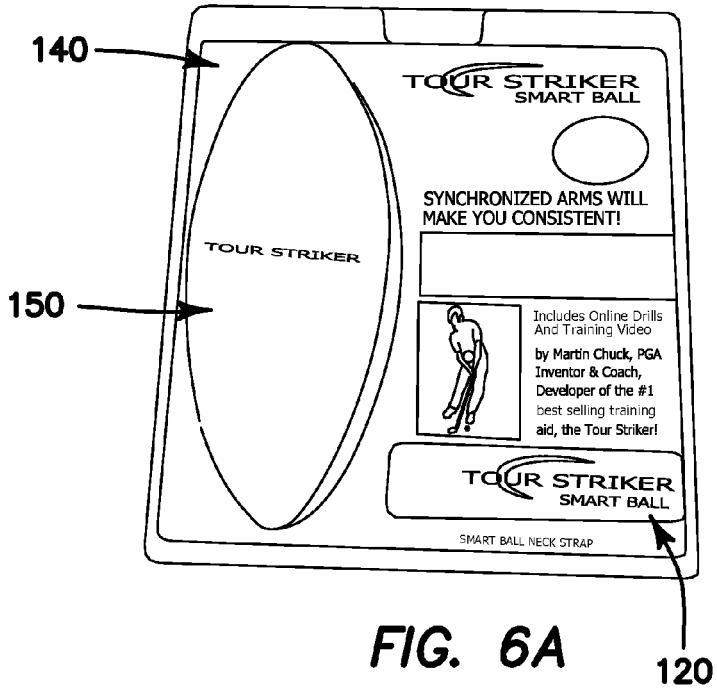
FIGS. 6A and 6B illustrate front and rear views of packaging for the golf swing apparatus according to the embodiments of the present invention.
Figure 6B:
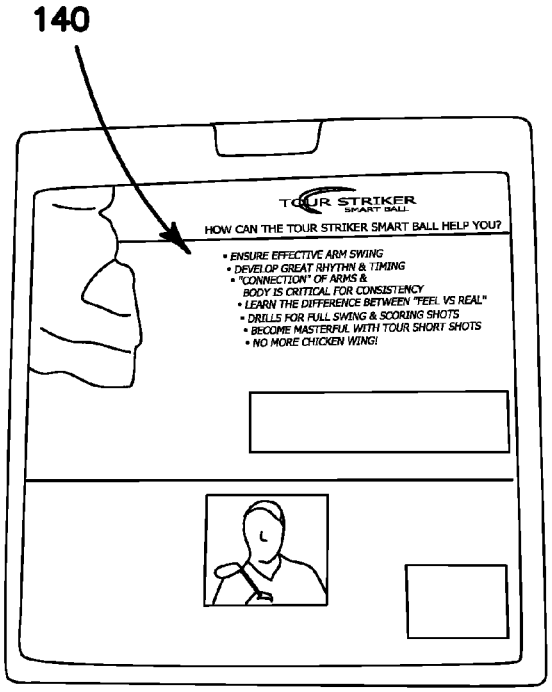

FIGS. 6A and 6B illustrate front and rear views of packaging 140 for the inflated ball 110 in a deflated configuration 150. A lanyard 120 is also included along with directions. Other types of packaging may be used as well.

While an inflatable ball is described above another embodiment utilizes a foam or sponge ball surrounded by a substantially rigid outer surface. A ball made of harder foam or sponge less prone to being overly deformed may also be used without a substantially rigid outer surface. Any resilient material, including foam, sponge and polymers, may be used.

Although the invention has been described in detail with reference to several embodiments, additional variations and modifications exist within the scope and spirit of the invention.

I claim:

1. A golf swing training apparatus, comprising:

an inflatable member, said inflatable member having a connection means;

a strap member connectable to said connection means, said strap member of a length to freely hang the inflatable member between a user's forearms when said strap member is worn around a user's neck; and wherein said inflatable member is dimensioned to be supported between a user's forearms during a golf swing, said strap member preventing said inflatable member from falling to the ground during a poor golf swing.

2. The golf swing training apparatus of claim 1 wherein said inflatable member is a spherical ball dimensioned to be supported between a user's forearms during a golf swing.

3. A golf swing training apparatus, comprising:

a resilient ball having a connection means;

a strap member connectable to said connection means, said strap member of a length to freely hang the inflatable member between a user's forearms when said strap member is worn around a user's neck; and wherein said resilient ball is dimensioned to be supported between a user's forearms during a golf swing, said strap member preventing said inflatable member from falling to the ground during a poor golf swing.

4. The golf swing training apparatus of claim 3 wherein said resilient ball is fabricated of foam.

5. The golf swing training apparatus of claim 4 wherein said foam ball has a substantially rigid outer surface.

* * * * *